United States Patent [19]

Ansbaugh

[11] Patent Number: 4,476,655

[45] Date of Patent: Oct. 16, 1984

[54] LINK AND FLIGHT ASSEMBLY FOR BLAST TREATMENT APPARATUS

[75] Inventor: Donald I. Ansbaugh, Granger, Ind.

[73] Assignee: Wheelabrator-Frye Inc., Mishawaka, Ind.

[21] Appl. No.: 410,619

[22] Filed: Aug. 23, 1982

[51] Int. Cl.[3] ..... B24B 47/02

[52] U.S. Cl. ..... 51/215 E; 51/418

[58] Field of Search ..... 51/410, 417–418, 51/163.1, 422–423, 215 E; 198/844, 850–852

[56] References Cited

U.S. PATENT DOCUMENTS

| | | | |
|---|---|---|---|
| 2,204,636 | 6/1940 | Turnbull | 51/418 |
| 2,305,451 | 12/1942 | Turnbull | 51/423 |
| 2,563,084 | 8/1951 | Turnbull | 51/163.1 |
| 2,909,012 | 10/1959 | Barnes | 51/163.1 |
| 3,048,947 | 8/1962 | Fahrney et al. | 51/163.1 |
| 3,079,735 | 3/1963 | Freeman | 51/163.1 |
| 3,691,690 | 9/1972 | Harper | 51/163.1 |

OTHER PUBLICATIONS

Wheelabrator Bulletin No. 213F.

*Primary Examiner*—Frederick R. Schmidt
*Assistant Examiner*—Matthew D. Daschel
*Attorney, Agent, or Firm*—McDougall, Hersh & Scott

[57] ABSTRACT

A link and flight assembly for a blast chamber conveyor is disclosed. The assembly includes a flight having a first surface formed of blast resistant materials, such as manganese. The flight is T-shaped in cross-section and is connected to the link by a mounting arm secured to the portion of the flight which is not subjected to blasting. This permits the use of inexpensive materials to join the link to the flight bar.

4 Claims, 5 Drawing Figures

LINK AND FLIGHT ASSEMBLY FOR BLAST TREATMENT APPARATUS

BACKGROUND OF THE INVENTION AND DISCUSSION OF THE PRIOR ART

This invention relates to a machine for cleaning the surfaces of articles, such as metal castings and the like, by throwing abrasive at the surfaces of the articles as they are tumbled about in a cabinet. It relates more particularly to a means for conveying the articles into and out of the cabinet and for providing for a continuous tumbling action within the machine during operation.

The invention is related to a centrifugal blasting machine of the type described in the Peik U.S. Pat. No. 2,104,055. Briefly described, such machines comprise a housing completely enclosing a conveying means formed of a plurality of flights which extend crosswise between endless chains for travel about a predetermined path with the flights preferably in overlapping relation at their edges to form an endless, horizontally disposed belt on which the work or articles to be cleaned are supported. The flights of the belt travel between a driving sprocket and a guide roller spaced forwardly and below the sprocket. Between the rollers and sprockets there is usually provided a pair of spaced circular drums mounted for rotational movement about a horizontal axis between the sprockets and rollers with a peripheral portion of the drum extending rearwardly and below the sprocket and rearwardly and below the roller whereby the upper flight of the belt travels horizontally and in a downward direction beyond the roller and upwardly and in a forwardly direction in advance of the sprocket. As a result, when the belt travels in the direction from the roller to the sprocket, the work will be carried up the belt and be caused to tumble forwardly continuously onto the underlying work. The endless belt doubles back beneath the upper flight for travel about the forward roller and about a rearward roller to the sprocket.

The area between the drums is substantially completely enclosed by the belt and other portions of the housing including a doorway through which access may be had to the top flight of the conveyor belt for loading and unloading the machine. One or more centrifugal blast wheels for throwing abrasive particles into the housing and onto the work are mounted on the housing with suitable attachments for feeding and driving the units. A detailed description thereof will not be made since they form no part of this invention and are adequately described in the aforementioned issued patent.

An improvement upon the Peik patent is described in a patent issued to Kenneth H. Barnes, U.S. Pat. No. 2,909,012. In this patent there is described a tumbling mill or centifugal blasting machine which maintains the flight bars of the conveyor substantially in continuous contacting relationship one with the other to provide a continuous conveyor which is free of openings between the flights during travel.

A refinement of the Barnes device is disclosed in U.S. Pat. No. 3,079,735 to Freeman which provides a continuous conveyor which is free of openings between the flights by virtue of a flexible sealing element provided for that purpose.

In the Freeman and similar prior art devices the flights are formed of relatively expensive materials, such as manganese, which are selected for their resistance to blast treatment. Such materials, of course, are relatively expensive and it is desirable, therefore, to minimize the use of such material to the extent practical. In that regard the Freeman device employs a system for joining the link and flight in which mounting holes are provided in the blast resistant portion of the flight. A connecting mechanism, in the form of a reinforcing bar attached to the link, is then secured to the flight bar by means of bolts which are received in the mounting holes in the blast resistant portion. In order to obtain maximum life from the flight, it is necessary that the bolts used also be of blast resistant material. Forming counter sunk holes in the blast resistant portion of the flight and providing blast resistant bolts significantly increases the cost of the flights.

It is accordingly an object of the present invention to provide a link and flight assembly in which the use of manganese or similar blast resistant material is minimized.

It is a further object of the invention to secure flights to links in a low cost manner not requiring the use of expensive, blast resistant fastening devices.

A further object of the invention is to provide a link and flight assembly in which the elements are interconnected without the need for tapping or drilling the surface of the flight which is subject to blast treatment thereby strengthening the assembly. The invention also provides for use of a backer bar extending full length of the flight. This provides maximum back-up strength for the flight.

Another object of the invention is to provide a novel linking arrangement for a link and flight assembly.

Other objects and advantages of the invention will be apparent from the remaining portion of the specification.

DETAILED DESCRIPTION

Figure 1:
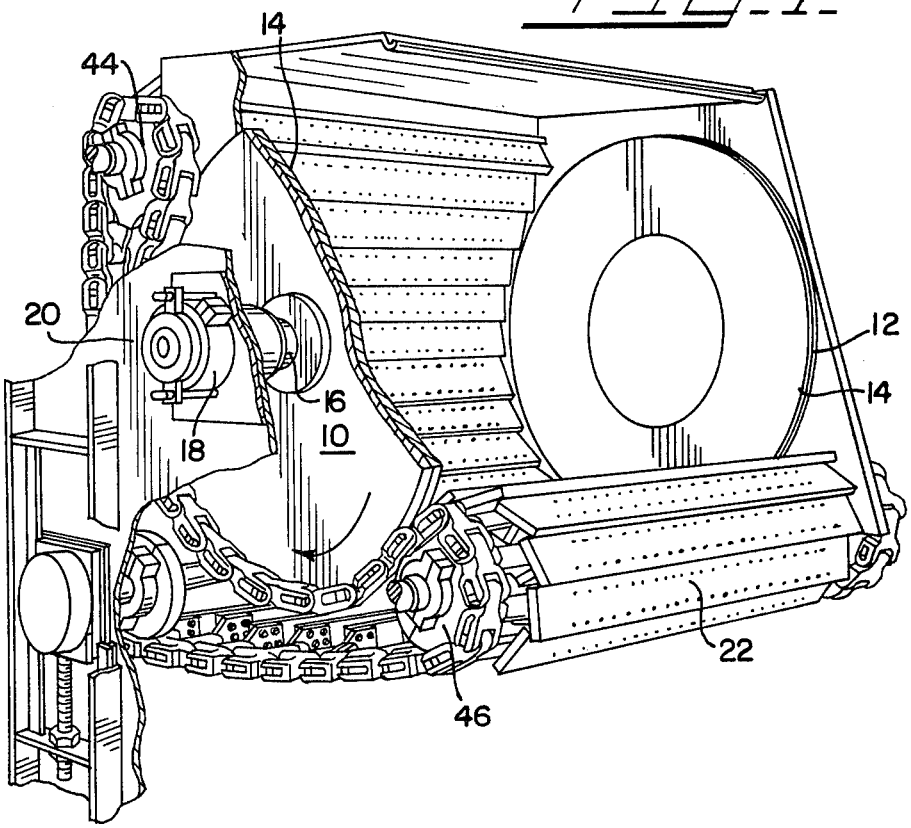
FIG. 1 is a perspective elevational view of a fragmentary portion of a blast machine illustrating the link and flight assembly according to the invention.
Figure 2:
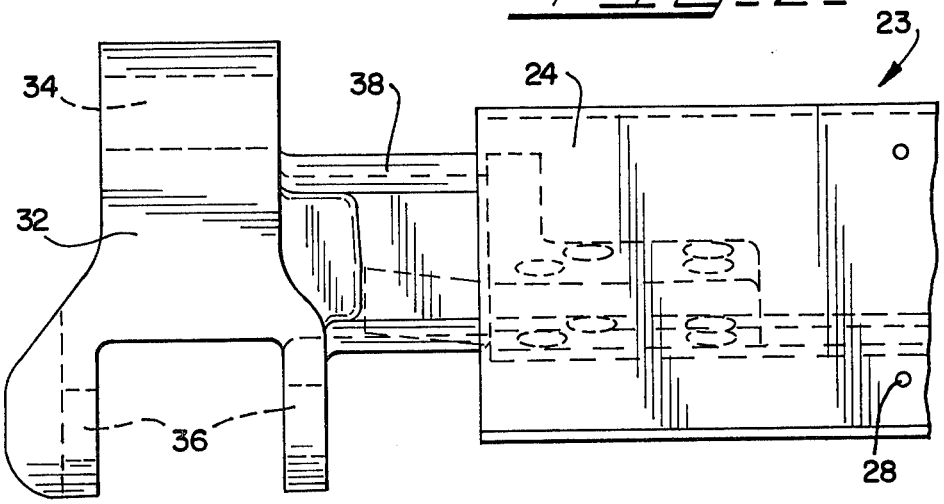
FIG. 2 is a front elevational view of the link and flight assembly according to the invention.
Figure 3:
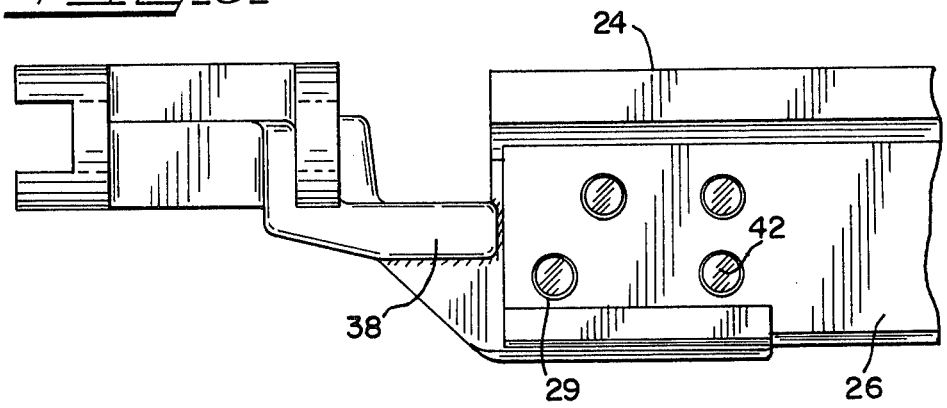
FIG. 3 is a bottom elevation of the assembly according to the invention.
Figure 4:
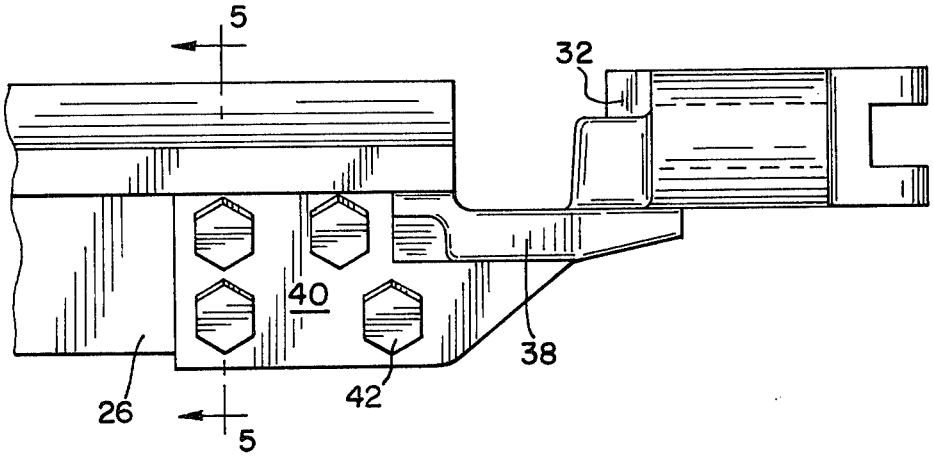
FIG. 4 is a top elevation of the assembly.
Figure 5:
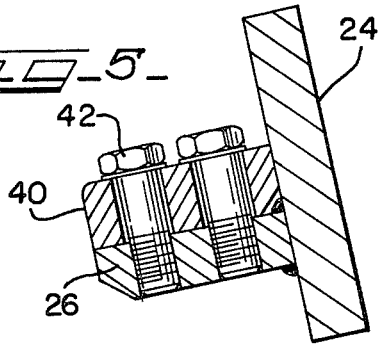
FIG. 5 is a cross-sectional view along the lines 5—5 of FIG. 4.

In FIG. 1 illustration is made of the conveyor and drum portion of the blast machine embodying the features of this invention comprising a pair of spaced drums 10 and 12 having liner plates 14 secured onto the inner faces thereof for purposes of protecting the drums against wear by the abrasive materials thrown at high velocity into the space between the drums. The drums are mounted on shafts 16 which are secured at their ends in journals 18 fixed to the frame plates 20 of the machine for enabling rotational movement of the drums about a horizontal axis.

For a more detailed explanation of the blast cabinet and operation thereof reference is made to the aforementioned U.S. Pat. Nos. 2,909,012 and 3,079,735.

Referring to FIGS. 2 through 5, the link and flight assembly according to the invention is illustrated in detail. The flight 23 is T-shaped in cross-section and includes a blast resistant surface 24 formed of a material such as manganese and a backer bar 26 formed of less expensive material, such as mild steel. The backer bar 26 is welded to the flight 24 to form the T-shaped configuration. The backer bar may be centrally located on the rear face of the blast surface 24 or offset somewhat from the center in order to provide clearance and proper sealing during operation. This aspect of the flight will vary according to the size and design requirements of the machine.

The blast resistant surface 24 has provided therein a number of drain holes 28 which permit abrasive to exit from the blast cabinet to be recycled to the blasting wheels for further treatment. The backer bar 26 includes a number of mounting holes 29 which are drilled therethrough to permit the flight assembly 23 to be secured to a link assembly 30.

The link assembly includes a link 32 having the usual apertures 34 and 36 at each end thereof dimensioned to interengage like elements of other flight and link assemblies by means of link pins, etc. A mounting arm 38, preferably integrally formed with the link element 32, extends transversely from the link and terminates in a generally rectangular mounting plate 40. The mounting plate is provided with holes corresponding to those provided on the backer bar 26 whereby bolts 42 can secure the assemblies together.

As will be observed, the blast resistant surface 24, subjected to the abrasive treatment, plays no part in securing the flight assembly 23 to the link assembly 30. Rather securing is accomplished by bolting mounting plate 40 of the arm 38 to the backer bar 26. This arrangement achieves a significant advantage over the prior art in that mounting bolt heads have been eliminated on the face of the flight which have proven to be a point of high wear. Only the blast resistant surface 24 need be of manganese or similar material while the backer bar 26, which is not subjected to blast treatment, may be of less expensive mild steel or the like. Further, since the bolting occurs on the backer bar, long life fasteners, of manganese or similar materials, need not be used as required in the prior art.

The invention results in a link and flight assembly which has improved wear characteristics to those of the prior art and which is significantly lower in cost because of the ability to use less costly bolts for joining the elements and the eliminating of mounting holes in blast resistant materials.

Operation of the blast cabinet is via a driving motor which turns the sprocket 44. The lugs of the sprocket which are enmeshed with the undercuts in the links cause the link chain to travel about the sprocket 44 and the roller 46. The flights move with the links to provide a continuously travelling, substantially continuous support on which the work is carried.

When the flights are advanced in the direction of the arrow in FIG. 1, the work will be carried into the machine and tumbled continuously one over another. When advanced in the reverse direction, the flights will carry the work over the hump about the roller 46 for delivery into a waiting receptacle. The abrasive particles thrown onto the tumbling work will sift downwardly gravitationally and fall through the plurality of openings 28 provided in the flights, first through the upper flight and then through the underlying return flight into a receptacle therebeneath.

While I have shown and described embodiments of this invention in some detail, it will be understood that this description and illustrations are offered merely by way of example, and that the invention is to be limited in scope only by the appended claims.

I claim:

1. A link and flight assembly for a blast cabinet conveyor comprising:

(a) a flight having a first element thereof formed of material which is highly resistant to blast treatment and a backer bar secured behind the flight;

(b) a pair of links including means for interengaging other links to form a conveyor belt of link and flight assemblies and means for securing said links to both ends of said flight only to said backer bar, said securing means including a mounting plate adapted to be releasably secured to said backer bar;

a mounting arm connecting said plate to said link, whereby only said first element of the flight need be formed of blast resistant material, the links, backer bar and securing means being formed of lower cost, less blast resistant materials.

2. The assembly according to claim 1 wherein said backer bar is secured in perpendicular relation to said first element to form a flight which is generally T-shaped in cross section.

3. The assembly according to claim 2 wherein said backer bar has a plurality of mounting holes provided therethrough and said securing means engages said holes to secure the links to each flight.

4. A link and flight assembly for a blast cabinet conveyor comprising:

(a) a flight including a blast resistant surface and a backer bar secured behind the flight in perpendicular relation thereto;

(b) a pair of links including means for interengaging other links to form a conveyor belt of link and flight assemblies and means for securing said links to both ends of said flight only to said backer bar, said securing means including a mounting plate adapted to be releasably secured to said backer bar;

a mounting arm connecting said plate to said link, whereby only said blast resistant surface need be formed of blast resistant material, the links, backer bar and securing means being formed of lower cost, less blast resistant materials.

* * * * *